US006026788A

United States Patent [19]

Wey

[11] Patent Number: 6,026,788

[45] Date of Patent: Feb. 22, 2000

[54] NONCONTACT FUEL ACTIVATING DEVICE

[76] Inventor: Albert C. Wey, 233 E. 57th St., Westmont, Ill. 60559

[21] Appl. No.: 09/237,002

[22] Filed: Jan. 25, 1999

Related U.S. Application Data

[63] Continuation-in-part of application No. 09/162,413, Sep. 28, 1998.

[51] Int. Cl.[7] ..... F02M 33/00

[52] U.S. Cl. ..... 123/538

[58] Field of Search ..... 123/536, 537, 123/538

[56] References Cited

U.S. PATENT DOCUMENTS

| | | | |
|---|---|---|---|
| 5,044,346 | 9/1991 | Tada et al. | 123/538 |
| 5,460,144 | 10/1995 | Park et al. | 123/538 |
| 5,873,353 | 2/1999 | Makita | 123/538 |

*Primary Examiner*—Marguerite McMahon
*Attorney, Agent, or Firm*—Piper Marbury Rudnick & Wolfe

[57] ABSTRACT

This invention describes a non-contact fuel-activating device comprising a housing means with a far infrared ray emitting body placed therein that provides a means for enhanced combustion of liquid fuels. The device can be installed externally on the fuel line before the point where fuel flows into a carburetor or fuel injection system. The result is improved fuel burning efficiency, increased engine power, and reduced harmful emissions.

7 Claims, 1 Drawing Sheet

NONCONTACT FUEL ACTIVATING DEVICE

This is a continuation-in-part of Application No. 09/162,413, filed Sep. 28, 1998.

BACKGROUND

1. Field of Invention

This invention relates to a device comprising a far infrared ray emitting body in a case that can be mounted externally on the fuel line of an internal combustion engine for activating the fuel to be efficiently combusted in the engine.

2. Description of Prior Art

There have been several types of devices developed for increasing engine performance as a result of improved fuel efficiency. For example, one type of devices induced a magnetic field in the fuel to break up the fuel into small particles (e.g. U.S. Pat. No. 5,271,369), the other employed techniques by catalytic cracking of long-chain liquid hydrocarbons (e.g. U.S. Pat. No. 5,092,303). However, these devices do not work satisfactorily. A far infrared ray generating composition was later added to the device employing magnetic field as an accessory for further improvement (e.g. U.S. Pat. No. 5,632,254). Another fuel activation device required contacting fuel with a functional ceramic emitting far infrared rays in a heated environment (e.g. U.S. Pat. No. 5,044,346). Such devices make implementation impractical and have little effect on fuel efficiency.

OBJECTS AND ADVANTAGES

Accordingly, one object of this invention is to provide a device that activates fuel to enhance combustion efficiency. As a result, this device can increase the power or acceleration of an internal combustion engine and, at the same time, reduce harmful emissions.

Another object of the present invention is to provide an easy-to-install and yet effective combustion enhancement device.

These objectives are achieved by a device comprising:

a housing;

and a far infrared ray emitting body disposed within said housing.

The device can be externally mounted on the nonmetal part (e.g. rubber) of a fuel line before the point where fuel flows into a carburetor or fuel injection system. The device is economical of fuel and installation of the device on the fuel line is easy, simple and safe.

DRAWING FIGURES

Reference Numerals in Drawings

11 Far infrared ray emitting body
12 Mounting case
13 Connecting hinge
14 Locking device
31 Wrap Straps
32 Fuel line

SUMMARY

In accordance with the present invention an external, non-contact fuel-activating device comprises a housing and a far infrared ray emitting body.

DETAILED DESCRIPTION OF THE INVENTION

Figure 1:
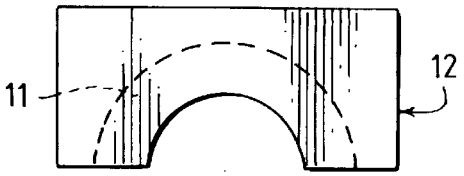
FIG. 1 shows the front view of one embodiment of the present invention with a far infrared ray emitting body in a semi-tubular form.

The device of the present invention comprises a case 12 that holds a far infrared ray emitting body 11. The case can be of any convenient shape and size. For ease of mounting on a fuel line, a semi-tubular shape is preferred. The material of the case can be plastic, metal, or any others. Among them, aluminum is preferred because of its high reflectivity to far infrared rays. Aluminum case works as a mirror that helps focus the far infrared rays on the fuel line. FIG. 1 shows a front view of the device having a semi-tubular far infrared ray emitting body 11 in an aluminum mounting case 12.

As an example of size, a semi-tubular far infrared ray emitting body 11 may have a typical length of 1.0 to 1.5 inches (2.5 to 3.8 mm approximately). The inner radius may be about ⅜ to ½ inch (9.5 to 12.7 mm) with a thickness of ⅛ inch (3.2 mm) or less for the wall. The aluminum housing 12 can be made in any shapes as long as it properly holds and protects the semi-tubular far infrared ray emitting body 11.

Figure 2:
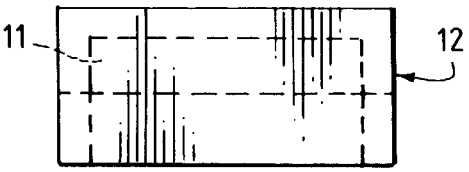
FIG. 2 shows the side view of the embodiment as described in FIG. 1.
Figure 3:
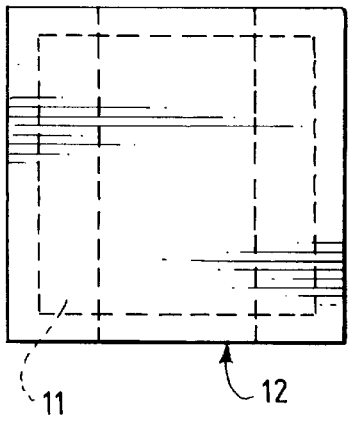
FIG. 3 shows the top view of the embodiment as described in FIG. 1

FIG. 2 and FIG. 3 show side view and top view of the device, respectively. The housing 12 provides an interior compartment for holding the far infrared ray emitting body 11. The far infrared emitting body is affixed to the housing wall with glue or by close fitting.

The far infrared ray emitting body 11 is composed of oxides selected from the group consisting alumina, silica, alumina hydrate, silica hydrate, zirconia, lithium oxide, magnesium oxide, calcium oxide, titanium oxide, or a mixture of said oxides. Based on our research results, ceramics containing iron oxides were less effective than others (or might even have a reverse effect that would require further studies) and should be avoided.

The present inventor has undertaken extensive studies to select a commercially available far infrared ray generating composition that possesses a strong radiation capacity in the desirable band of wavelengths, 8 to 14 microns (micrometers). As a result, the inventor found that the far infrared ray generating composition fabricated by the method involving inorganic powders having a particle size below 1,000 angstrom provided a larger radiation effect. Sample composition and fabrication method can be found in, for example, U.S. Pat. No. 4,886,972. Nevertheless, the inventor further found that only those far infrared emitting body comprising mixtures of compounds having an ultrafine inorganic powder with a particle size smaller than 100 angstroms would emit considerable radiation that could effectively enhance fuel combustion efficiency at a very significant level.

Figure 4:
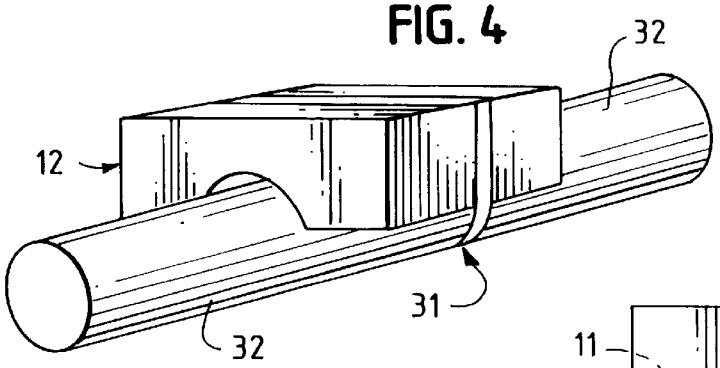
FIG. 4 shows a view of mounting the device of the present invention on a fuel line.

FIG. 4 shows the installation of the device. The device can be easily mounted externally on a fuel line 32 with wrap straps 31 or the like. Please note that the device must be mounted on the nonmetal part of the fuel line, e.g. a rubber fuel line, as the far infrared rays could not penetrate into a metal fuel line.

Figure 5:
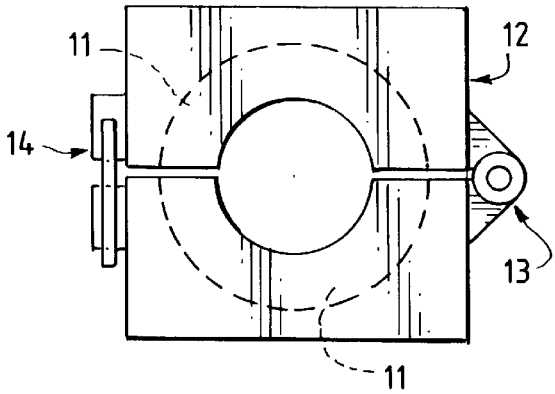
FIG. 5 shows the front view of another embodiment of the present invention in a format with a pair of cases connected with a hinge and secured with a locking device.

Another embodiment is shown in FIG. 5. It consists of a pair of cases that was described in FIG. 1. These two cases are connected by a hinge 13 and secured by a locking device 14. When used in pair, the aluminum cases 12 work as a resonator that helps concentrate the far-infrared energy within the radiation zone in the fuel line.

Figure 6:
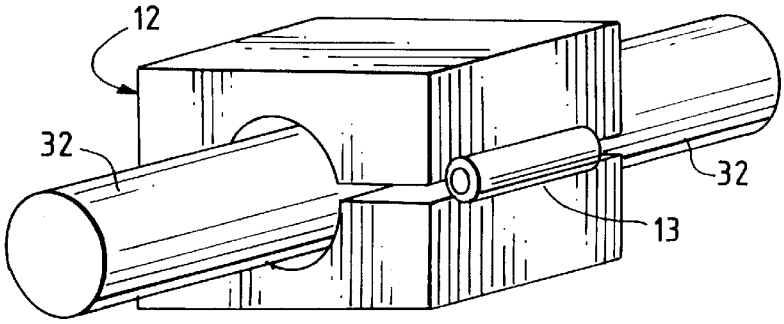
FIG. 6 shows a view of mounting the device as described in FIG. 5 on a fuel line.

The device can be easily installed on the fuel line by mounting the device on a rubber part of the fuel line as shown in FIG. 6. No tool or modification of the fuel line is needed.

EXAMPLE

A commercially available ceramic composition made in Japan was used to form the tubular infrared ray emitting body in the invention, with an inner diameter of about ⅜ inch (9.5 mm) and an outer diameter of about ½ inch (12.7 mm). The length was about 1.0 inch (25.4 mm). The core material of the composition was alumina hydrate, mixed with various oxides such as zirconia, lithium oxide, and titanium oxide. The composition had a desirable particle size of about 50 angstroms. The composition emitted infrared radiation in the wavelength region of about 8 to 14 microns. Two prototypes of the present invention were made and mounted on various cars for testing. A 1998 Grand Marquis with an odometer reading of 17,300 miles was used to test the effectiveness of the device. Preliminary results showed an average of 17% savings on gasoline consumption,. with an increase in highway gas mileage from 26.8 mpg (mile per gallon) without device to 31.4 mpg with device installed. Reading with an exhaust analyzer, the amount of hydrocarbon (HC) reduced by 38% from a 0.208 gpm (grams per mile) without device to a 0.130 gpm with device installed. Carbon monoxide (CO) had dropped 35% from 2.709 gpm to 1.776 gpm.

Conclusion, Ramifications, and Scope

According to the present invention, an external device comprising a mounting case, preferably in aluminum, and a far infrared ray emitting body having a particle size smaller than 1,000 angstrom, preferably 200 angstrom or smaller, can effectively enhance combustion efficiency. As a result, this device will increase the power and acceleration of an internal combustion engine and reduce harmful emissions.

This device can be easily installed on nearly every car and burner in the world with little effort.

The invention has been described above. Obviously, numerous modifications and variations of the present invention are possible in light of the above teachings. Such variations are not to be regarded as a departure from the spirit and scope of the invention and all such modifications as would be obvious to one skilled in the art are intended to be included within the scope of the following claims.

I claim:

1. A device mounted adjacent to and exterior of a fuel line of an internal combustion engine for activating the fuel and for thereby achieving efficient combustion of the fuel, said device consisting essentially of a housing and a far infrared ray emitting body located within the housing whereby fuel in the fuel line is exposed to infrared emissions, said body being formed of far infrared ray emitting particles having an ultrafine particle size, and a radiation capacity in the band of wavelengths between 8 and 14 microns wherein the fuel line in the region adjacent to the device is free of any significant magnetic influence.

2. The far infrared ray emitting body according to claim 1, wherein said ultrafine powder has a particle size 100 angstroms or below.

3. The device according to claim 1, wherein said far infrared ray emitting body takes a semi-tubular shape.

4. The device according to claim 1, wherein said housing is made of aluminum.

5. The device according to claim 1, wherein said housing comprises first and second aluminum cases arranged in opposite relationship, with a fuel line extending between the first and second cases.

6. A device according to claim 1 wherein the particles are selected from the group consisting of alumina, silica, alumina hydrate, silica hydrate, zirconia, lithium oxide, magnesium oxide, calcium oxide, titanium oxide, or a mixture of said oxides.

7. A device according to claim 1 wherein said particle size is 1000 angstroms or less.

* * * * *